United States Patent [19]

Flochel

[11] Patent Number: 5,043,014

[45] Date of Patent: Aug. 27, 1991

[54] THERMOPLASTIC PASTE FOR THE PRODUCTION OF FOUNDRY MOLD CORES AND A PROCESS FOR THE PRODUCTION OF SUCH CORES USING SAID PASTE

[75] Inventor: Jean-Pierre Flochel, Asnieres, France

[73] Assignee: Societe Nationale d'Etude et de Construction de Moteurs d'Aviation "S.N.E.C.M.A.", Paris, France

[21] Appl. No.: 308,527

[22] Filed: Feb. 10, 1989

[30] Foreign Application Priority Data

Feb. 10, 1988 [FR] France ..... 88 01535

[51] Int. Cl.[5] ..... C04B 35/68

[52] U.S. Cl. ..... 106/38.3; 106/38.27; 106/38.9; 501/107

[58] Field of Search ..... 501/106, 107; 106/38.2, 106/38.22, 38.27, 38.3, 38.35, 38.9

[56] References Cited

U.S. PATENT DOCUMENTS

| | | | |
|---|---|---|---|
| 4,093,017 | 6/1978 | Miller et al. | 164/28 |
| 4,190,450 | 2/1980 | Robb et al. | 106/38.9 |
| 4,236,568 | 12/1980 | Larson | 164/41 |
| 4,844,148 | 7/1989 | Cuisin et al. | 164/519 |

FOREIGN PATENT DOCUMENTS

| | | |
|---|---|---|
| 0056662 | 7/1982 | European Pat. Off. . |
| 0179649 | 4/1986 | European Pat. Off. . |
| 2213120 | 8/1974 | France . |
| 2336998 | 7/1977 | France . |
| 2371257 | 6/1978 | France . |
| 2569586 | 3/1986 | France . |

*Primary Examiner*—William R. Dixon, Jr.
*Assistant Examiner*—Chris Gallo
*Attorney, Agent, or Firm*—Oblon, Spivak, McClelland, Maier & Neustadt

[57] ABSTRACT

A thermoplastic paste for the production of foundry mold cores comprises, per 100 parts by weight of mineral filler comprised of fused silica, zircon and cristobalite, between 0.2 and 0.5 parts by weight of a mold release agent, and an organic binder formed by at least 15 to 20 parts by weight of polyethylene glycol having an average molecular weight between 1400 and 1600. A process suitable for the production of foundry mold cores from such a past comprises a shaping stage followed by a single firing cycle in four steps, namely, (a) raising the temperature to 500° C., at a rate of between 30° C. and 50° C. per hour.

(b) raising the temperature from 500° C. to a maximum temperature, at a rate of between 100° C. and 200° C. per hour.

(c) maintaining the said maximum temperature for a period of between 4 and 5 hours, and (d) cooling rapidly using pulsed air.

11 Claims, No Drawings

THERMOPLASTIC PASTE FOR THE PRODUCTION OF FOUNDRY MOLD CORES AND A PROCESS FOR THE PRODUCTION OF SUCH CORES USING SAID PASTE

BACKGROUND OF THE INVENTION

1. Field of the Invention

The present invention relates to a thermoplastic paste intended for the production of foundry mold cores, and to a process for the production of such mold cores using the said paste.

The use of foundry mold cores of the type known as "ceramic" is well known for certain applications which demand achievement of a combination of properties and strict quality criteria such as high-temperature resistance, non-reactivity, dimensional stability and good mechanical properties. Particular examples of applications having requirements of this kind are aeronautical applications such as the foundry production of turbine blades for turbojet engines. The improvement of foundry processes, evolving from the equiaxis foundry technique to the directional solidification or the monocrystalline foundry techniques, has further added to these requirements concerning mold cores whose use and complexity have been imposed by the search for high performances for the objects which are to be produced, as is the case for example with hollow blades having internal cooling.

2. Summary of the Prior Art

Some known examples of compositions intended for the production of mold cores of this kind are described in Fr-A-2,371,257, and essentially comprise fused silica, zircon flour, and cristobalite (which is a form of crystallized silica). A silicone resin is used as a binding material, and additional components such as a lubricant and a catalyst are added in small quantities. In FR-A-2,569,586 the addition of a catalyst is avoided by exploiting certain properties of the resin which is used in the production process.

Previously known compositions have not however been entirely satisfactory in certain particular applications of the directional solidification foundry technique or the monocrystalline foundry technique applied to turbine blades. Improvements are particularly sought in relation to the surface qualities and a diminution of the roughness of the mold cores obtained with the aim of making the process easier to carry out, avoiding the presence of odors due to certain products, enabling sizing of the mold cores to be carried out before firing, and also improving the production process for the mold cores, particularly by simplifying and reducing the duration of the firing cycles. In the case of certain applications, previous compositions have also resulted in problems of fragility or insufficient dimensional stability in the mold cores.

It is an object of the invention, therefore, to overcome these problems and to provide an improved composition for use in the production of foundry mold cores.

A further object is to provide an improved process for producing foundry mold cores using the said composition and involving a simplified firing cycle.

SUMMARY OF THE INVENTION

According to the invention there is provided a thermoplastic paste for the production of foundry mold cores, comprising a mineral filler composed of, by weight, from 60% to 85% fused silica, from 15% to 35% zircon, and from 1% to 5% cristobalite, said paste also comprising, per 100 parts by weight of said mineral filler, from 0.2 to 0.5 parts by weight of a mold release agent, and from at least 15 to 20 parts by weight of an organic binder formed by a polyethylene glycol having a molecular weight between 1400 and 1600.

If desired, the paste may also comprise a plasticizer, such as cetyl alcohol in from 1 to 5 parts by weight.

Further according to the invention there is provided a process for the production of foundry mold cores utilizing said thermoplastic paste of the invention, said process comprising the steps of:

providing said thermoplastic paste;

subjecting said paste to a shaping operation to form a mold core; and subjecting said shaped mold core to a single firing cycle comprising the following four steps, (a) raising the temperature to 500° C. at a rate of between 30° C. and 50° C. per hour, (b) raising the temperature from 500° C. to a predetermined maximum temperature at a rate of between 100° C. and 200° C. per hour, (c) maintaining the temperature at said maximum temperature for a period of between 4 and 5 hours, and (d) cooling rapidly using pulsed air, so as to ensure, in the one firing cycle, elimination of the binder, consolidation by sintering of the material of the mold core, and stabilization of the core structure by conversion of amorphous silica into cristobalite, the total duration of the firing cycle being between 24 and 36 hours.

The maximum temperature reached may be 1200° C. or 1250° C., depending on the intended use.

The mineral filler which is used in the composition in accordance with the present invention is formed, as is known, from a mixture having suitable granulometries, of fused silica (or vitreous silica), zircon and cristobalite. Good results are obtained by using a filler in which the fused silica content comprises, from 15 to 80% by weight of the filler, a fused silica of granulometry from 0 to 63 micrometers and, from 0 to 60% by weight of the filler, a fused silica of granulometry from 0 to 100 micrometers. Preferably the zircon has a granulometry from 0 to 50 micrometers, and the cristobalite is preferably in the form of a flour, which is a fine powdery material, having a granulometry less than 50 micrometers, and preferably less than 20 micrometers.

The presence of cristobalite, preferably having very fine granulometry, is important in the compositions of the invention. It is known that materials containing amorphous silica (or fused silica) have poor flow behaviour. Obtaining foundry mold cores which can be used at high temperatures requires a conversion of the amorphous silica into cristobalite, which is the only stable phase for silica between 1470° C. and 1710° C. and is also the phase having the best flow behaviour, a desirable property in the use of foundry mold cores. Under the conditions described above in the process in accordance with the invention, the cristobalite which is initially present acts as an accelerator for the devitrification of the fused silica into cristobalite during the increase in temperature. Another remarkable result and important advantage which is obtained is that, after firing, the foundry mold cores are not subject to any significant dimensional variation when they are subsequently brought, in use, to temperatures of the order of 1500° C.

The mineral filler is added, usually in two or three stages, to the organic binder and the mold release agent in a mixer to form the thermoplastic paste. In accordance with the invention, the organic binder is a polyethylene glycol having an average molecular weight of between 1400 and 1600, and the mold release agent is preferably calcium stearate.

After mixing, the thermoplastic paste obtained may be crushed or ground before being shaped and fired in the production of the foundry mold cores.

Further details and advantages of the invention will become apparent from the following description of non-limiting embodiments of the invention.

DESCRIPTION OF THE PREFERRED EMBODIMENTS

Example 1

A thermoplastic paste is formed from:

a mineral filler composed of, by weight,

77% fused silica, of granulometry from 0 to 63 micrometers,

20% zircon, of granulometry from 0 to 50 micrometers, and

3% cristobalite, of granulometry from 2 to 5 micrometers, and, per 100 parts by weight of the mineral filler, 0.5 parts by weight of a mold release agent consisting of calcium stearate, 18 parts by weight of an organic binder consisting of polyethylene glycol of molecular weight 1550, and 4.5 parts by weight of cetyl alcohol.

Example 2

A thermoplastic paste is formed having the same composition as in Example 1 described above, except for the binder which in this case consists of 20 parts by weight of polyethylene glycol of molecular weight 1550.

Example 3

A thermoplastic paste is formed having the same composition as in Example 1, except that the binder consists of 17 parts by weight of polyethylene glycol of molecular weight 1550, and the fused silica used in the mineral filler has a granulometry from 0 to 50 micrometers.

Example 4

A thermoplastic paste is formed having the same composition as in Example 3, except that the fused silica content of the mineral filler is constituted by:

17% fused silica of granulometry from 0 to 50 micrometers, and

60% fused silica of granulometry from 0 to 100 micrometers.

These thermoplastic pastes in accordance with the invention can be shaped to form the required foundry mold cores using known techniques, such as molding, e.g. by thermoplastic injection molding. In this case the paste mixture is preferably injected at between 50° C. and 100° C. into a mold at ambient temperature, where it solidifies.

As is usual, the foundry mold cores, after being shaped, must undergo a firing operation before being used for casting objects. For this operation, each mold core may be placed in a preformed mold, or, and this is the preferred method, it may be placed in a bed of alumina sand which envelops the mold core. It may also be desirable to coat the surface of the mold core with an anti-adhesive substance, such as PTFE, before embedding the core in the sand. It will be noted that this manner of firing, i.e. "firing in sand", also provides a saving in the production time, which allows a greater number of mold cores to be set. In every case, the sand used exhibits good absorbing properties with respect to the decomposition products of the binders and of PTFE.

The firing cycle in the production process in accordance with the invention comprises four steps:

(a) raising the temperature to 500° C. at a rate of between 30° C. and 50° C. per hour, (b) raising the temperature from 500° C. to a maximum temperature at a rate of between 100° C. and 200° C. per hour, (c) holding the temperature at the said maximum temperature for a period of between 4 and 5 hours, and (d) cooling rapidly using pulsed air.

This cycle ensures a uniform removal of the binders and good reproducibility of the dimensions of the mold cores obtained. Also, where assuring good quality results, the firing cycle used in the process in accordance with the invention has a significantly reduced total duration in relation to previously known firing processes. The choice of organic binder as polyethylene glycol appears to be a particularly determining factor for obtaining these results.

In certain particular applications, requiring mold cores of complex shape and for which strict quality criteria are imposed, such as in the manufacture of turbine blades for high performance turbine aero engines, the rise in temperature to a maximum temperature of 1200° C. or 1250° C. in step (b) of the firing cycle is preferably carried out over a period of 9 hours, and the cooling in step (d) of the firing cycle is carried out over a period of 12 hours, leading to a total firing cycle duration of 36 hours.

Another remarkable advantage of the process, which has a direct bearing on production costs by reducing production times, is that the firing cycle is the only firing which is applied to the mold cores. This single cycle simultaneously ensures the removal of the binder, the consolidation of the material of the mold cores by sintering, and the stabilization of the resulting structure, by virtue of the presence of cristobalite.

The mold cores which are obtained have advantageous properties which have been revealed following trials on test pieces, and among which may be highlighted:

a service temperature up to 1550° C.;

a modulus of rupture of 110 kg/cm$^2$ at 1100° C. after 5 minutes, and of 95 kg/cm$^2$ at 1500° C. after 15 minutes;

a bulk density of 1.72 and an actual density of 2.4;

a porosity of 28%; and a thermal expansion at 1000° C. of 0.13% to 0.16%.

Possible correction of the mold cores after injection may be carried out by recalibration in a template by virtue of the malleability of the thermoplastic pastes in accordance with the invention. This advantage, as well as the absence of deformation of the mold cores during operations subsequent to shaping, appears to be due to the effect of the organic binder in the form of polyethylene glycol. Indeed, this component has properties of progressive solidification, without abrupt termination of its viscous properties, between 50° C. and 100° C., in contrast with a number of previously used binding materials. The dimensional stability and the absence of flow thus constitute important advantages of the foundry mold cores obtained from the thermoplastic pastes in accordance with the invention.

I claim:

1. A thermoplastic paste for the production of foundry mold cores, comprising a mineral filler composed of, by weight, from 60% to 85% fused silica, from 15% to 35% zircon, and from 1% to 5% cristobalite, said paste also comprising, per 100 parts by weight of said mineral filler, from 0.2 to 0.5 parts by weight of a mold release agent, and from at least 15 to 20 parts by weight of an organic binder formed by a polyethylene glycol having a molecular weight between 1400 and 1600.

2. A thermoplastic paste as claimed in claim 1, wherein said paste further comprises from 1 to 5 parts by weight of cetyl alcohol as a plasticizer.

3. A thermoplastic paste as claimed in claim 1, wherein said mold release agent is calcium stearate.

4. A thermoplastic paste as claimed in claim 1, wherein the zircon in said mineral filler has a granulometry of less than 50 μm.

5. A thermoplastic paste as claimed in claim 1, wherein the cristobalite in said mineral filler has a granulometry of less than 20 μm.

6. A thermoplastic paste as claimed in claim 1, wherein from 15% to 80% by weight of said mineral filler is provided by fused silica having a granulometry of less than 63 μm.

7. A thermoplastic paste as claimed in claim 1, wherein from 0 to 60% of said mineral filler is provided by fused silica having a granulometry of less than 100 μm.

8. A thermoplastic paste for the production of foundry mold cores, comprising a mineral filler composed of, by weight, 77% fused silica of granulometry of less than 63 μm, 20% zircon in the form of a flour of granulometry of less than 50 μm, and 3% cristobalite, said paste also comprising, per 100 parts by weight of said mineral filler, 0.5 parts by weight of calcium stearate, 18 parts by weight of polyethylene glycol having an average molecular weight of 1550, and 4.5 parts by weight of cetyl alcohol.

9. A thermoplastic paste for the production of foundry mold cores, comprising a mineral filler, composed of, by weight, 77% fused silica of granulometry of less than 63 μm, 20% zircon in the form of a flour of granulometry of less than 50 μm, and 3% cristobalite of granulometry from 2 to 5 micrometers, said paste also comprising, per 100 parts by weight of said mineral filler, 0.5 parts by weight of calcium stearate, 20 parts by weight of polyethylene glycol having an average molecular weight of 1550, and 4.5 parts by weight of cetyl alcohol.

10. A thermoplastic paste for the production of foundry mold cores, comprising a mineral filler, composed of, by weight 77% fused silica of granulometry of less than 50 μm, 20% zircon in the form of a flour of granulometry of less than 50 μm, and 3% cristobalite, said paste also comprising, per 100 parts by weight of said mineral filler, 0.5 parts by weight of calcium stearate, 17 parts by weight of polyethylene glycol having an average molecular weight of 1550, and 4.5 parts by weight of cetyl alcohol.

11. A thermoplastic paste for the production of foundry mold cores, comprising a mineral filler, composed of, by weight, 60% fused silica of granulometry of less than 100 μm, 17% fused silica of granulometry of less than 50 μm, 20% zircon in the form of a flour of granulometry from 0 to 50 μm, and 3% cristobalite, said paste also comprising, per 100 parts by weight of said mineral filler, 0.5 parts by weight of calcium stearate, 17 parts by weight of polyethylene glycol having an average molecular weight of 1550, and 4.5 parts by weight of cetyl alcohol.

* * * * *